US011591822B2

(12) United States Patent
Wang

(10) Patent No.: US 11,591,822 B2
(45) Date of Patent: Feb. 28, 2023

(54) MULTI-KEY LOCK CORE

(71) Applicant: SINOX CO., LTD, New Taipei (TW)

(72) Inventor: Chia-Hung Wang, New Taipei (TW)

(73) Assignee: SINOX CO., LTD., New Taipei (TW)

( * ) Notice: Subject to any disclaimer, the term of this patent is extended or adjusted under 35 U.S.C. 154(b) by 318 days.

(21) Appl. No.: 17/092,428

(22) Filed: Nov. 9, 2020

(65) Prior Publication Data

US 2021/0140197 A1 May 13, 2021

(30) Foreign Application Priority Data

Nov. 11, 2019 (TW) ..... 108214938

(51) Int. Cl.
*E05B 29/00* (2006.01)
*E05B 35/10* (2006.01)
(Continued)

(52) U.S. Cl.
CPC ..... *E05B 29/0046* (2013.01); *E05B 29/0013* (2013.01); *E05B 29/0066* (2013.01);
(Continued)

(58) Field of Classification Search
CPC .... E05B 29/00; E05B 29/0013; E05B 29/004; E05B 29/0046; E05B 29/0066;
(Continued)

(56) References Cited

U.S. PATENT DOCUMENTS 3,621,689 A * 11/1971 Koskinen et al. .... E05B 21/066 70/366
5,544,509 A * 8/1996 Mielonen ..... E05B 21/066 70/366

(Continued)

FOREIGN PATENT DOCUMENTS

EP 3584393 A1 * 12/2019 ..... E05B 29/0066

*Primary Examiner* — Christopher J Boswell
(74) *Attorney, Agent, or Firm* — Birch, Stewart, Kolasch & Birch, LLP

(57) ABSTRACT

A multi-key lock core includes a housing, a driving cylinder, a plurality of circular lock plates, and a lock rod. The driving cylinder is disposed in the housing, a sidewall of the driving cylinder is provided with a penetration portion, and the driving cylinder is rotatable to the penetration portion to correspond to an engagement recessed portion. The circular lock plates are disposed in the driving cylinder and each include an outer edge provided with a first recessed portion, and the outer edge of at least one of the circular lock plates is further provided with a second recessed portion. The lock rod is disposed in the penetration portion, and may partially enter the engagement recessed portion to restrict rotation of the driving cylinder. A first key may push the circular lock plates to rotate to the first recessed portion to correspond to the penetration portion, so that the lock rod can move to partially enter the first recessed portion and detach from the engagement recessed portion. The second key may push the circular lock plates to rotate to the second recessed portion and the first recessed portion to correspond to the penetration portion, so that the lock rod can move to partially enter the second recessed portion and the first recessed portion and detach from the engagement recessed portion.

10 Claims, 11 Drawing Sheets

(51) Int. Cl.
*E05B 35/08* (2006.01)
*E05B 65/52* (2006.01)

(52) U.S. Cl.
CPC ..... *E05B 35/08* (2013.01); *E05B 35/105* (2013.01); *E05B 65/52* (2013.01); *E05Y 2900/602* (2013.01)

(58) Field of Classification Search
CPC ..... E05B 35/08; E05B 35/10; E05B 35/105; E05B 35/14; E05B 65/52
See application file for complete search history.

(56) References Cited

U.S. PATENT DOCUMENTS

| | | | | |
|---|---|---|---|---|
| 5,613,389 | A * | 3/1997 | Hauser | E05B 29/0013 70/366 |
| 6,758,074 | B1 * | 7/2004 | Prunbauer | E05B 29/0013 70/403 |
| 6,799,447 | B2 * | 10/2004 | Mielonen | E05B 21/066 70/366 |
| 10,174,521 | B2 * | 1/2019 | Lin | E05B 29/0066 |
| 10,240,364 | B2 * | 3/2019 | Wehr | E05B 29/0066 |
| 10,876,322 | B2 * | 12/2020 | Yoshida | E05B 29/006 |
| 2015/0152666 | A1 * | 6/2015 | Ho | E05B 29/0066 70/353 |

* cited by examiner

MULTI-KEY LOCK CORE

BACKGROUND

Technical Field

The utility model relates to a multi-key lock core. Further, the utility model relates to a lock core that can be unlocked and locked with multiple keys.

Related Art

Locks have long been widely used in a variety of devices and items that need to be preserved. Padlocks are used for items such as cabinets, suitcases, travel bags, and electronic devices to prevent other people from unlocking and taking away the items. A passenger usually lock his/her suitcase to avoid pilferage during air, sea or land travel.

In order to ensure security, security checks are becoming increasingly stringent during transport. A suitcase used during travel often has to go through a lot of security checks, especially when it comes to air transport. In order to check a luggage, security personnel needs to open a lock on the luggage. However, because a lock core of each lock needs to be opened with a different key, unlocking is time-consuming for a luggage check.

SUMMARY

The utility model is directed to a multi-key lock core, so as to resolve the above problems in the prior art.

The multi-key lock core of the utility model is configured for use in combination with a first key and a second key. The multi-key lock core includes a housing, a driving cylinder, a plurality of circular lock plates, and a lock rod. The housing includes a housing inner wall, the housing inner wall is provided with an engagement recessed portion, and the housing inner wall defines a cylindrical accommodating space with a first port and a second port. The driving cylinder is disposed in the cylindrical accommodating space, and provided with a driving cylinder opening and a driving cylinder end portion corresponding to the first port and the second port respectively on two opposite ends, a sidewall of the driving cylinder is provided with a penetration portion, and the driving cylinder is rotatable relative to an axis to the penetration portion to correspond to the engagement recessed portion. The plurality of circular lock plates are arranged in parallel to each other in the driving cylinder and are rotatable along the axis, each of the circular lock plates includes an inner edge provided with a driving protrusion portion and an outer edge provided with a first recessed portion, and the outer edge of at least one of the circular lock plates is further provided with a second recessed portion. The lock rod is disposed in the penetration portion and partially enters the engagement recessed portion to restrict rotation of the driving cylinder relative to the housing. When the first key is inserted between the circular lock plates through the first port and the driving cylinder opening, the first key pushes, through the driving protrusion portion, the circular lock plates to rotate to the first recessed portion to correspond to the penetration portion, and the lock rod is movable to partially enter the first recessed portion and detach from the engagement recessed portion, so that the driving cylinder is rotatable relative to the housing. When the second key is inserted between the circular lock plates through the first port and the driving cylinder opening, the second key pushes, through the driving protrusion portion, the circular lock plates to rotate to the second recessed portion and the first recessed portions of the circular lock plates not provided with the second recessed portion to correspond to the penetration portion, and the lock rod is movable to partially enter the second recessed portion and the first recessed portions of the circular lock plates not provided with the second recessed portion and detach from the engagement recessed portion, so that the driving cylinder is rotatable relative to the housing.

In an embodiment of the utility model, outer surfaces of the first key and the second key are provided with a first guide slot and a second guide slot extending along an axial direction of the first key and the second key respectively, and the first guide slot and the second guide slot each include a bending portion extending along a circumferential direction of the first key and the second key. When the first key is inserted between the circular lock plates through the first port and the driving cylinder opening, the driving protrusion portion enters the first guide slot, and a sidewall of the first guide slot abuts against the driving protrusion portion and pushes the circular lock plates to rotate to the first recessed portion to correspond to the penetration portion. When the second key is inserted between the circular lock plates through the first port and the driving cylinder opening, the driving protrusion portion enters the second guide slot, and a sidewall of the second guide slot abuts against the driving protrusion portion and pushes the circular lock plates to rotate to the second recessed portion and the first recessed portions of the circular lock plates not provided with the second recessed portion to correspond to the penetration portion.

In an embodiment of the utility model, the outer edge of each of the circular lock plates is further provided with a reset bevel. The driving cylinder further includes a reset device, and when the circular lock plates are disposed in the driving cylinder, the reset device abuts against the reset bevel to drive the circular lock plates to rotate to a predetermined position.

In an embodiment of the utility model, the outer edge of each of the circular lock plates is further provided with a limiting portion. The driving cylinder further includes a limiting opening portion, and when the circular lock plates are disposed in the driving cylinder, the limiting portion is located in the limiting opening portion, and the limiting opening portion restricts a range of rotation of the circular lock plates relative to the driving cylinder.

In an embodiment of the utility model, the multi-key lock core further includes a plurality of spacers disposed between the circular lock plates.

In an embodiment of the utility model, the multi-key lock core includes a housing, a driving cylinder, a first circular lock plate, a second circular lock plate, and a lock rod. The housing includes a housing inner wall, the housing inner wall is provided with an engagement recessed portion, and the housing inner wall defines a cylindrical accommodating space with a first port and a second port. The driving cylinder is disposed in the cylindrical accommodating space, and provided with a driving cylinder opening and a driving cylinder end portion corresponding to the first port and the second port respectively on two opposite ends, a sidewall of the driving cylinder is provided with a penetration portion, and the driving cylinder is rotatable relative to an axis to the penetration portion to correspond to the engagement recessed portion. The first circular lock plate is disposed in the driving cylinder and rotatable along the axis, is provided with a driving protrusion portion on an inner edge, and is provided with a first A recessed portion on an outer edge.

The second circular lock plate is disposed in parallel to the first circular lock plate in the driving cylinder and rotatable along the axis, is provided with the driving protrusion portion on an inner edge, and is provided with a first B recessed portion and a second recessed portion on an outer edge. The lock rod is disposed in the penetration portion and partially enters the engagement recessed portion to restrict rotation of the driving cylinder relative to the housing. When the first key is inserted between the first circular lock plate and the second circular lock plate through the first port and the driving cylinder opening, the first key pushes, through the driving protrusion portion, the first circular lock plate and the second circular lock plate to rotate to the first A recessed portion and the first B recessed portion to correspond to the penetration portion, and the lock rod is movable to partially enter the first A recessed portion and the first B recessed portion and detach from the engagement recessed portion, so that the driving cylinder is rotatable relative to the housing. When the second key is inserted between the first circular lock plate and the second circular lock plate through the first port and the driving cylinder opening, the second key pushes, through the driving protrusion portion, the first circular lock plate and the second circular lock plate to rotate to the first A recessed portion and the second recessed portion to correspond to the penetration portion, and the lock rod is movable to partially enter the first A recessed portion and the second recessed portion and detach from the engagement recessed portion, so that the driving cylinder is rotatable relative to the housing.

In an embodiment of the utility model, outer surfaces of the first key and the second key are provided with a first guide slot and a second guide slot extending along an axial direction of the first key and the second key respectively, and the first guide slot and the second guide slot each include a bending portion extending along a circumferential direction of the first key and the second key. When the first key is inserted between the first circular lock plate and the second circular lock plate through the first port and the driving cylinder opening, the driving protrusion portion enters the first guide slot, and a sidewall of the first guide slot abuts against the driving protrusion portion and pushes the first circular lock plate and the second circular lock plate to rotate to the first A recessed portion and the first B recessed portion to correspond to the penetration portion. When the second key is inserted between the first circular lock plate and the second circular lock plate through the first port and the driving cylinder opening, the driving protrusion portion enters the second guide slot, and a sidewall of the second guide slot abuts against the driving protrusion portion and pushes the first circular lock plate and the second circular lock plate to rotate to the first A recessed portion and the second recessed portion to correspond to the penetration portion.

In an embodiment of the utility model, outer edges of the first circular lock plate and the second circular lock plate each are further provided with a reset bevel. The driving cylinder further includes a reset device, and when the first circular lock plate and the second circular lock plate are disposed in the driving cylinder, the reset device abuts against the reset bevel to drive the first circular lock plate and the second circular lock plate to rotate to a predetermined position.

In an embodiment of the utility model, outer edges of the first circular lock plate and the second circular lock plate each are further provided with a limiting portion The driving cylinder further includes a limiting opening portion, and when the first circular lock plate and the second circular lock plate are disposed in the driving cylinder, the limiting portion is located in the limiting opening portion, and the limiting opening portion restricts a range of rotation of the first circular lock plate and the second circular lock plate relative to the driving cylinder.

In an embodiment of the utility model, the multi-key lock core further includes a spacer disposed between the first circular lock plate and the second circular lock plate.

DETAILED DESCRIPTION

Figure 1:
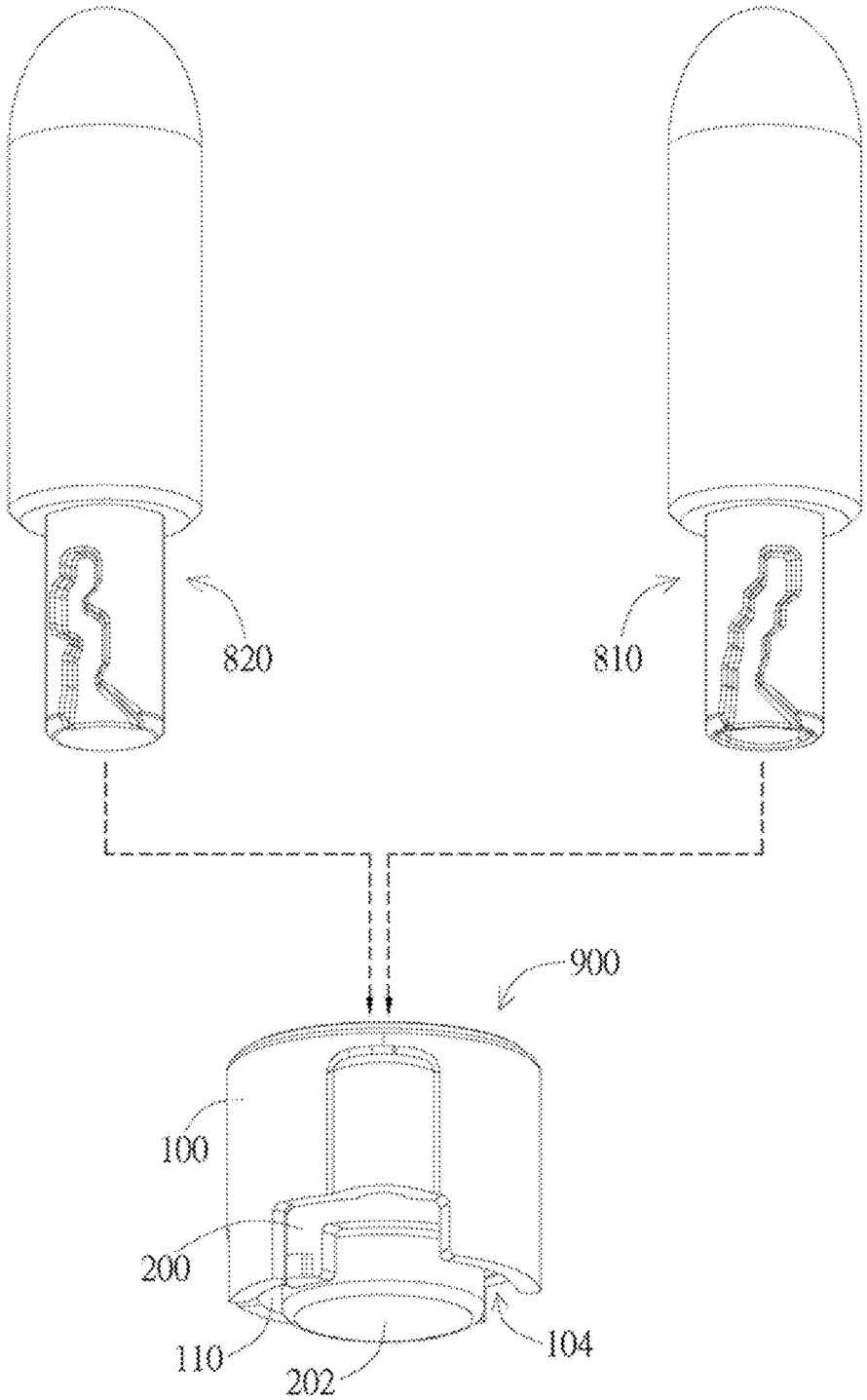
FIG. 1 is a schematic view of an embodiment of a multi-key lock core according to the utility model.
Figure 2A:
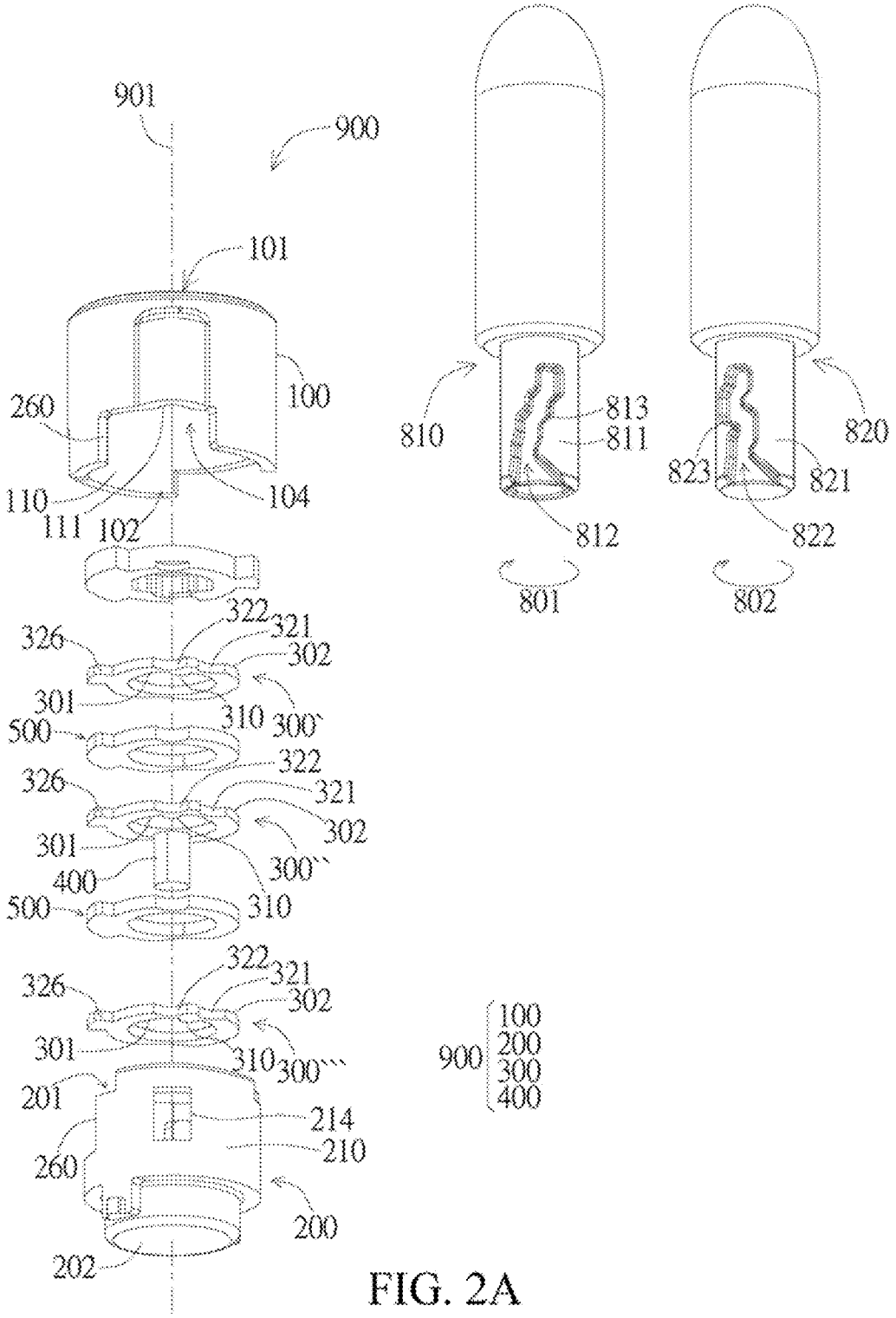
FIGS. 2A and 2B are exploded schematic views of the embodiment of the multi-key lock core according to the utility model.

In an embodiment as shown in FIG. 1 and FIG. 2A, a multi-key lock core 900 according to the utility model is configured for use in combination with a first key 810 and a second key 820. Further, the first key 810 may be, for example, a personal key owned by a user who has, for example, a suitcase equipped with the multi-key lock core 900, and the second key 820 may be a check key owned by a law enforcement agency such as the customs.

Figure 2B:
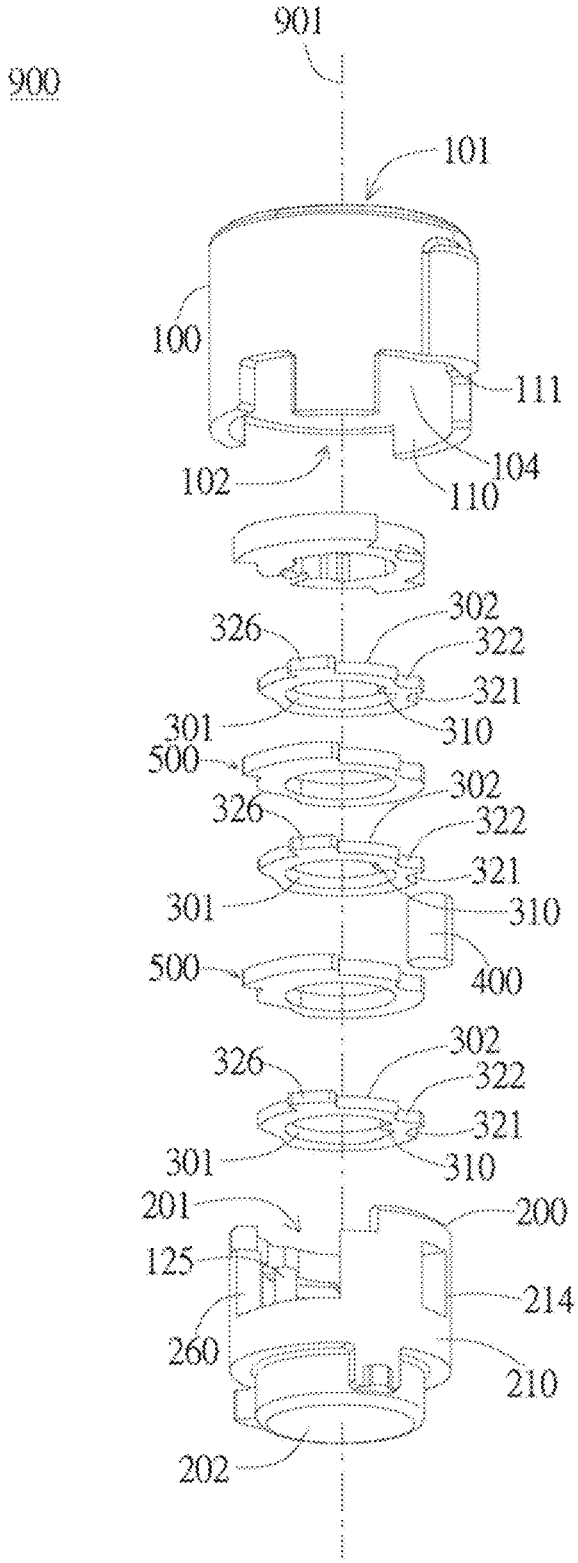

In the embodiment as shown in FIG. 2A and FIG. 2B, the multi-key lock core 900 includes a housing 100, a driving cylinder 200, a plurality of circular lock plates 300, and a lock rod 400. The housing 100 includes a housing inner wall 110, the housing inner wall 110 is provided with an engagement recessed portion 111, and the housing inner wall 110 defines a cylindrical accommodating space 104 with a first port 101 and a second port 102. In particular, in this embodiment, the housing 100 is of a cylindrical shape with the first port 101 and the second port 102 respectively at its upper and lower parts, and has the cylindrical accommodating space 104 inside. However, in different embodiments, the housing 100 is not limited to the cylindrical shape. For example, plates inside a square shell may define a cylinder. Inside the cylinder is the cylindrical accommodating space 104, and the cylinder is provided with the first port 101 and the second port 102 at its upper and lower parts respectively.

In the embodiments as shown in FIG. 1 to FIG. 2B, the driving cylinder 200 is disposed in the cylindrical accommodating space 104. In other words, the driving cylinder 200 is sleeved in the housing 100, and is surrounded by the housing inner wall 110. In the embodiments as shown in FIG. 2A and FIG. 2B, a driving cylinder opening 201 and a driving cylinder end portion 202 corresponding to the first port 101 and the second port 102 are disposed on two opposite ends of the driving cylinder 200 respectively. In particular, "corresponding" herein means that when the driving cylinder 200 is disposed in the cylindrical accommodating space 104, the first port 101 is adjacent to and in communication with the driving cylinder opening 201, and the second port 102 is adjacent to and extends out of the driving cylinder end portion 202. A sidewall 210 of the driving cylinder 200 is provided with a penetration portion 214, and the driving cylinder 200 is rotatable relative to an axis 901 to the penetration portion 214 to correspond to the engagement recessed portion 111. In an embodiment, the driving cylinder end portion 202 is further connected to, for example, a lock member such as a tongue plate or a hook. When the driving cylinder 200 rotates, the lock member may be driven to rotate to unlock the item. Connections and actions of the lock core and the lock member are known in the art and therefore will not be illustrated or described herein.

In the embodiments shown in FIG. 2A and FIG. 2B, circular lock plates 300', 300", and 300'" are arranged in parallel to each other in the driving cylinder 200 and are rotatable along the axis 901. The circular lock plates 300', 300", and 300'" each include an inner edge 301 provided with a driving protrusion portion 310 and an outer edge 302 provided with a first recessed portion 321. The outer edge 302 of at least one of the circular lock plates 300', 300", and 300'" is further provided with a second recessed portion 322. Further, in this embodiment, the outer edges 302 of the circular lock plates 300', 300", and 300'" are all provided with the second recessed portion 322. However, in different embodiments, the number of the circular lock plates is not limited to 3 and may be any value greater than 2, and the outer edge of only one of the circular lock plates is provided with the second recessed portion. The multi-key lock core 900 may further include a plurality of spacers 500 disposed between the circular lock plates 300', 300", and 300'" to reduce friction and other obstacles caused by direct contact between the circular lock plates 300', 300", and 300'" during rotation.

Figure 3:
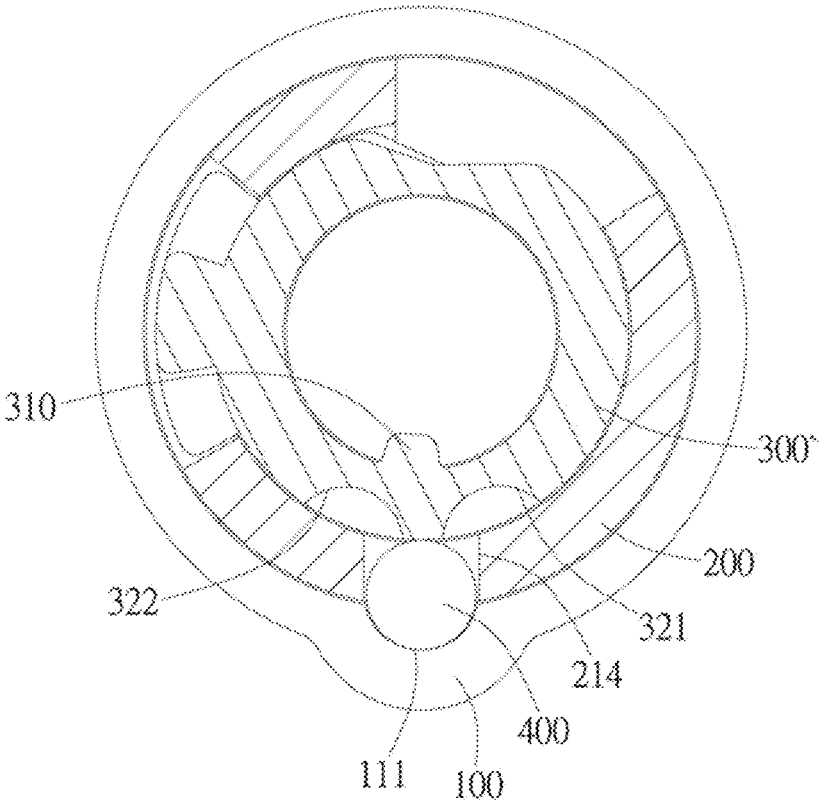
FIG. 3 is a schematic cross-sectional view of the embodiment of the multi-key lock core according to the utility model.

In the embodiment as shown in FIG. 3, the lock rod 400 is disposed in the penetration portion 214, and may partially enter the engagement recessed portion 111 to restrict rotation of the driving cylinder 200 relative to the housing 100. Viewed from different angles, in case that there is no space on the other side of the driving cylinder 200 relative to the housing 100 to let the lock rod 400 at least partially enter, move into, and detach from the engagement recessed portion 111, because the lock rod 400 is partially in the penetration portion 214 and the engagement recessed portion 111 respectively, rotation of the driving cylinder 200 relative to the housing 100 may be restricted. In an embodiment, the lock rod 400 is a cylinder, and the engagement recessed portion 111 has an arc-shaped inner wall to correspond to a surface of the cylinder.

Figure 4A:
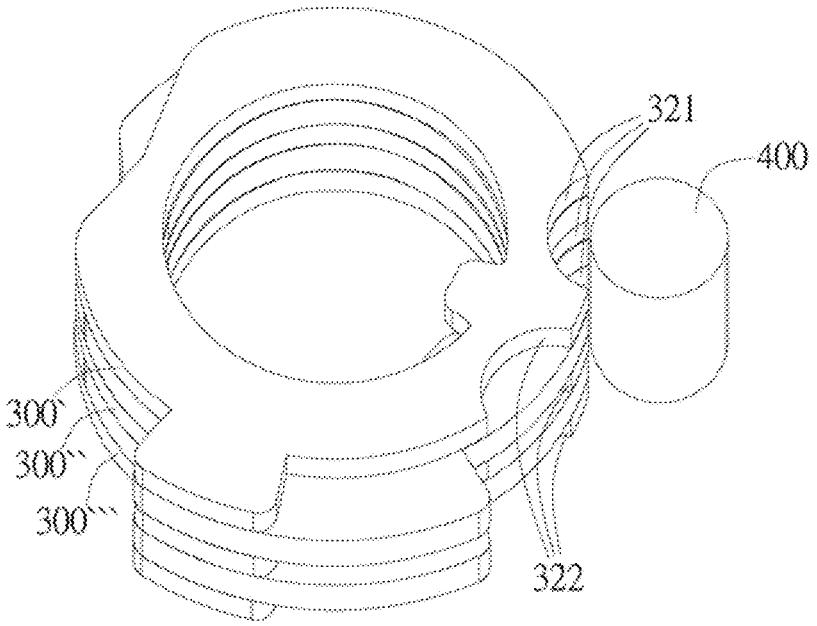
FIG. 4A is a schematic view of relative positions of a circular lock plate and a lock rod in a multi-key lock core according to the utility model.
Figure 4B:
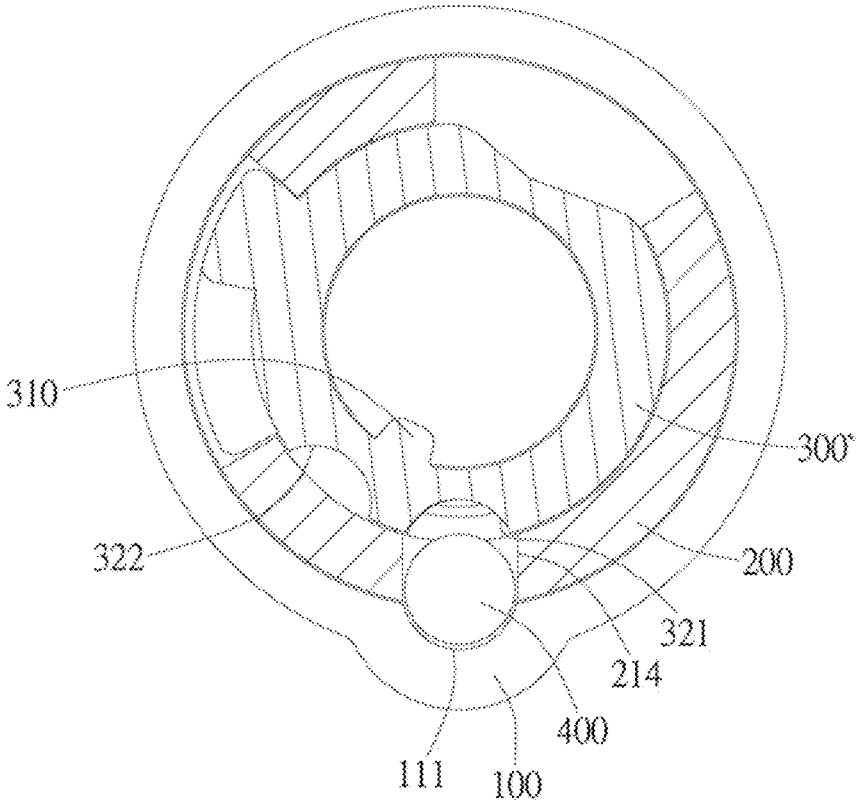
FIGS. 4B to 4D are schematic views of an embodiment of a penetration portion corresponding to a first recessed portion in a multi-key lock core according to the utility model.
Figure 4C:
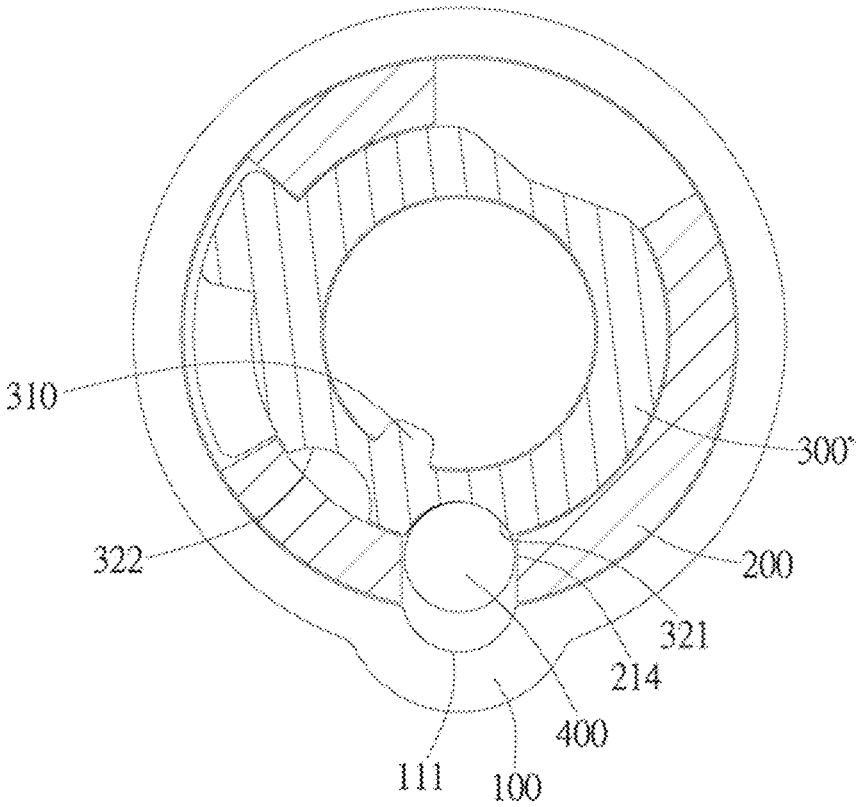
Figure 4D:
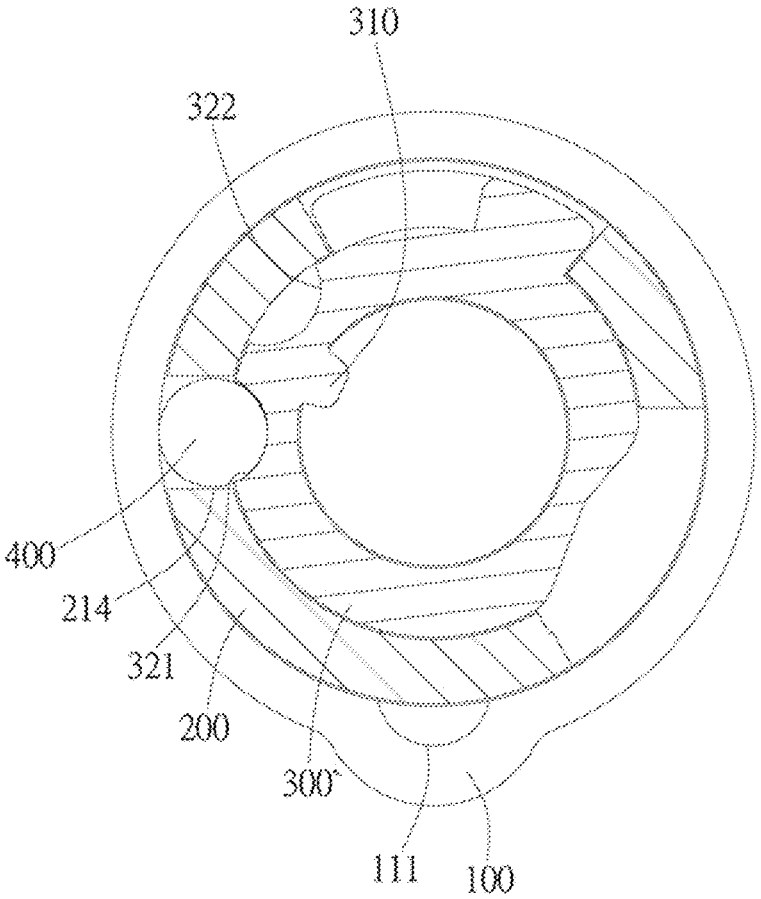

In the embodiment as shown in FIG. 2A, when the first key 810 is inserted between the circular lock plates 300', 300", and 300'" through the first port 101 and the driving cylinder opening 201, the first key 810 may push, through the driving protrusion portion 310, the circular lock plates 300', 300", and 300'" to rotate to a position of the first recessed portion 321 corresponding to the lock rod 400 as shown in FIG. 4A. In this case, as shown in FIG. 4B, the first recessed portion 321 corresponds to the penetration portion 214. In particular, an outer surface 811 of the first key 810 is provided with a first guide slot 812 extending along an axial direction of the first key 810. The first guide slot 812 includes a bending portion 813 extending along a circumferential direction 801 of the first key 810. When the first key 810 is inserted between the circular lock plates 300', 300", and 300'" through the first port 101 and the driving cylinder opening 201, the driving protrusion portion 310 enters the first guide slot 812, and a sidewall of the first guide slot 812 abuts against the driving protrusion portion 310 to push the circular lock plates 300', 300", and 300'" to rotate to the first protrusion portion 321 corresponding to the penetration portion 214. Accordingly, as shown in FIG. 4C, the lock rod 400 is movable to partially enter the first protrusion portion 321 and detach from the engagement recessed portion 111, so that the driving cylinder 200 may rotate relative to the housing 100 as shown in FIG. 4D, so as to drive the lock member to release the locking.

Figure 5:
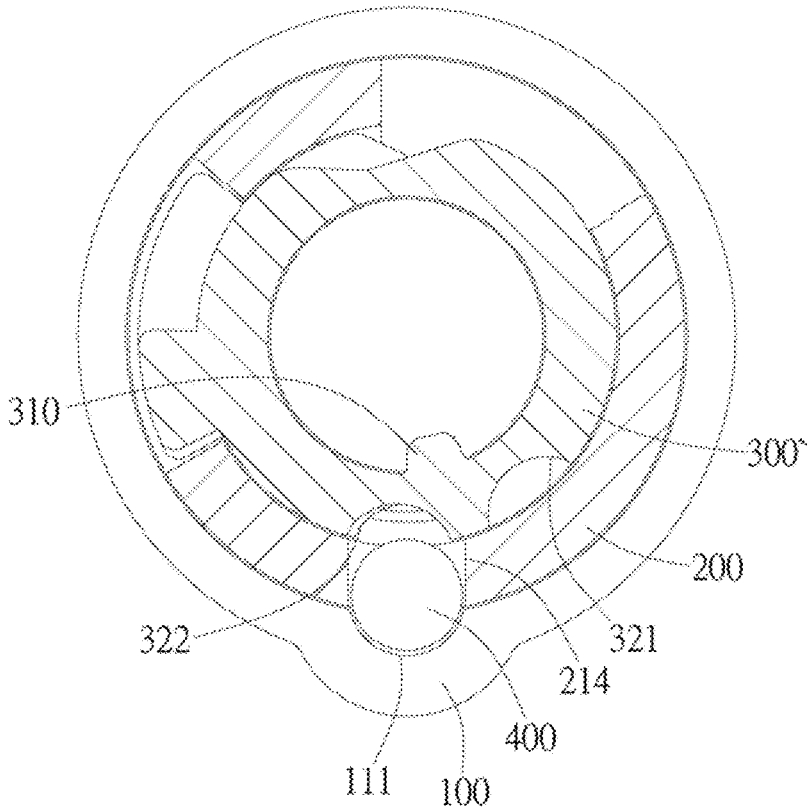
FIG. 5 is a schematic view of an embodiment of a penetration portion corresponding to a second recessed portion in a multi-key lock core according to the utility model.

On the other hand, in the embodiment as shown in FIG. 2A, when the second key 820 is inserted between the circular lock plates 300', 300", and 300'" through the first port 101 and the driving cylinder opening 201, the second key 820 may push, through the driving protrusion portion 310, the circular lock plates 300', 300", and 300'" to rotate to the second recessed portion 322 corresponding to the penetration portion 214 as shown in FIG. 5, and the lock rod 400 is movable to partially enter the second recessed portion 322 and detach from the engagement recessed portion 111, so that the driving cylinder 200 is rotatable relative to the housing 100. In particular, an outer surface 821 of the second key 820 is provided with a second guide slot 822 extending along an axial direction of the second key 820. The second guide slot 822 includes a bending portion 823 extending along a circumferential direction 802 of the second key 820. When the second key 820 is inserted between the circular lock plates 300', 300", and 300'" through the first port 101 and the driving cylinder opening 201, the driving protrusion portion 310 enters the second guide slot 822, and a sidewall of the second guide slot 822 abuts against the driving protrusion portion 310 to push the circular lock plates 300', 300", and 300'" to rotate to the second recessed portion 322 to correspond to the penetration portion 214.

In the above embodiment, the circular lock plates 300', 300", and 300'" are all provided with the second recessed portion 322. However, in different embodiments, the outer edge of only one of the circular lock plates is provided with the second recessed portion 322. In this case, when the second key 820 is inserted between the circular lock plates, the second key 820 may push, through the driving protrusion portion 310, the circular lock plates to rotate to the second recessed portion 322 and the first recessed portions 321 of the circular lock plates not provided with the second recessed portion 322 to correspond to the penetration portion 214, and the lock rod 400 is movable to partially enter the second recessed portion 322 and the first recessed portions 321 of the circular lock plates not provided with the second recessed portion 322.

Figure 6:
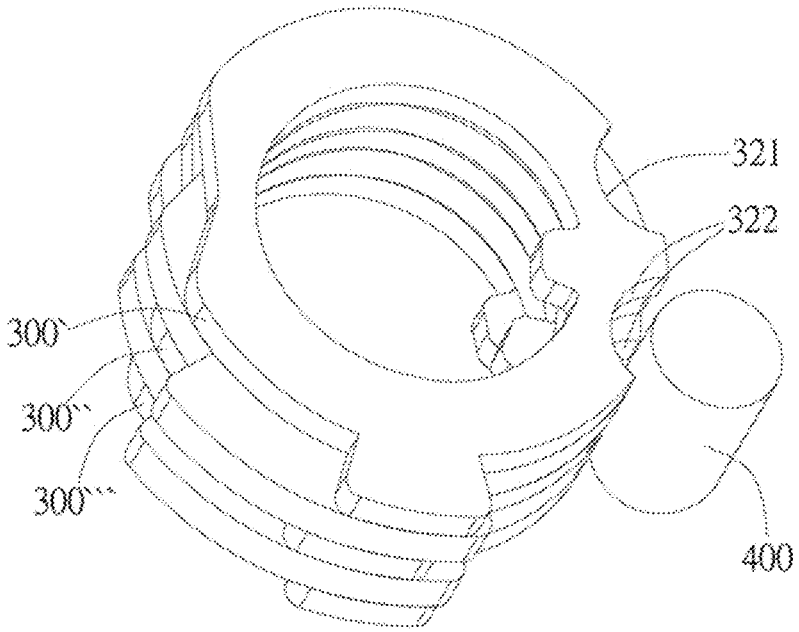
FIG. 6 is a schematic view of an embodiment of an engagement recessed portion not corresponding to a lock rod in a multi-key lock core according to the utility model.

Further, a key with a correct guide slot is a correct key, then the circular lock plates may be driven, through the driving protrusion portion, to rotate to the first recessed portion or the second recessed portion to correspond to the lock rod in the penetration portion, the lock rod may move to detach from the engagement recessed portion, and the driving cylinder may rotate relative to the housing, which is an unlocked state. In the embodiment as shown in FIG. 6, when an inserted key is incorrect, the recessed portion of at least one circular lock plate may not correspond to the lock rod, the rod cannot move to detach from the engagement recessed portion, and rotation of the driving cylinder relative to the housing is restricted, which is a locked state. Also, with the setting of multiple recessed portions (e.g., the first recessed portion, the second recessed portion, etc.), the lock core of the utility model can achieve a function of using multiple keys to operate and rotate the driving cylinder for unlocking and locking, so that a lock provided with the lock core of the utility model can make check of the law enforcement agency such as the customs more convenient and more efficient.

Figure 7A:
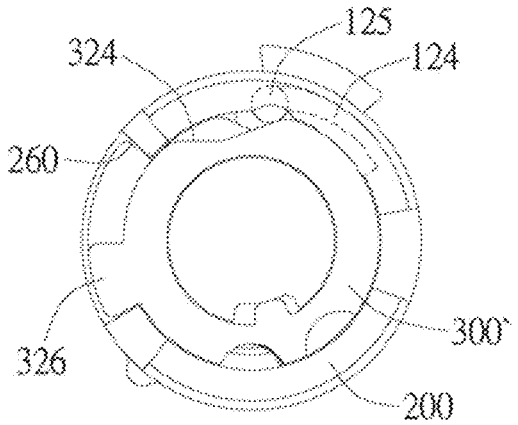
FIGS. 7A to 7C are schematic views of different embodiments of a multi-key lock core according to the utility model.
Figure 7B:
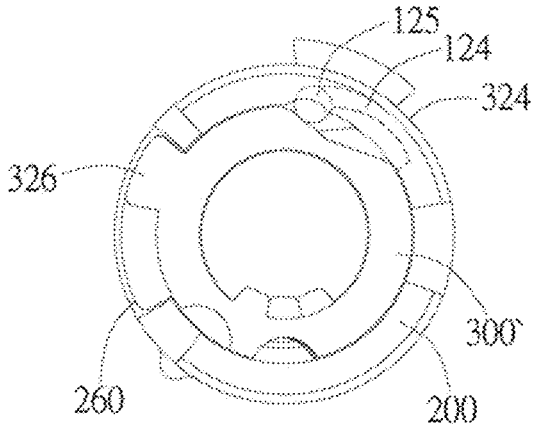
Figure 7C:
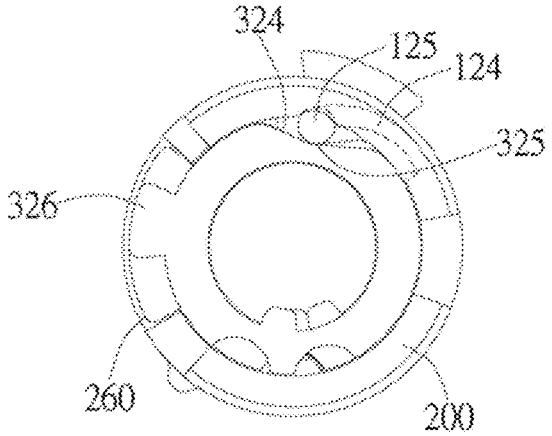

In the embodiments as shown in FIG. 7A to FIG. 7C, the outer edges 302 of the circular lock plates 300', 300", and 300'" each are further provided with a reset bevel 324. Since the circular lock plates 300', 300", and 300'" are arranged in parallel to each other with the axis as a center, only the circular lock plates 300' are shown in FIG. 7A to FIG. 7C. In addition, for conciseness of the figures, elements such as the lock rod and the housing are not drawn. The driving cylinder 200 further includes a reset device, 124, and when the circular lock plates 300', 300", and 300'" are disposed in the driving cylinder 200, the reset device 124 abuts against the reset bevel 324. In this case, the reset device 124 causes the circular lock plates 300', 300", and 300'" to rotate to a predetermined position as shown in FIG. 7C. In particular, the reset bevel 324 includes a concave angle 325, and the reset device 124 includes an elastic arm with an end portion 125 abutting against the reset bevel 324. When the circular lock plates 300', 300", and 300'" rotate to the positions as shown in FIG. 7A and FIG. 7B, the end portion 125 of the reset device 124 abuts against a position other than the concave angle 325 of the reset bevel 324, so as to apply a force to the reset bevel 324 to cause the circular lock plates 300', 300", and 300'" to rotate to a position where the end portion of the reset device 124 abuts against the concave angle 325, i.e., the predetermined position as shown in FIG. 7C. If the predetermined position is defined as a zero position of the circular lock plates 300', 300", and 300'", with the setting of the reset bevel 324 and the reset device 124, the circular lock plates 300', 300", and 300'" can be automatically zeroed without inserting a key to apply a force to the circular lock plates 300', 300", and 300'", thus improving convenience of use.

In the embodiments as shown in FIG. 7A to FIG. 7C, the outer edges 302 of the circular lock plates 300', 300", and 300'" each are further provided with a limiting portion 326. The driving cylinder 200 further includes a limiting opening portion 260, and when the circular lock plates 300', 300", and 300'" are disposed in the driving cylinder 200, the limiting portion 326 is located in the limiting opening portion 260, and the limiting opening portion 260 restricts a range of rotation of the circular lock plates 300', 300", and 300'" relative to the driving cylinder 200. Accordingly, a range of rotation of the driving protrusion portion 310 can be restricted, so that when a key is inserted, the driving protrusion portion 310 can enter the guide slot more easily, improving convenience of use.

Although preferred embodiment of the utility model have been disclosed with the above description and figures, it should be understood that various additions, modifications, and replacements are applicable to the preferred embodiment of the utility model without departing from the spirit and scope of the principle of the utility model as defined in the appended claims. It would be appreciated by a person of ordinary skill in the art that the utility model is applicable to lots of modifications in terms of forms, structures, arrangement, proportions, materials, elements, and components. Therefore, the embodiments disclosed herein should be considered as describing the utility model, but are not intended to limit the utility model. The scope of the utility model should be defined by the appended claims and include legal equivalents thereof, and is not limited to the above description.

What is claimed is:

1. A multi-key lock core, configured for use in combination with a first key and a second key, the multi-key lock core comprising:

a housing, comprising a housing inner wall, the housing inner wall being provided with an engagement recessed portion, and defining a cylindrical accommodating space with a first port and a second port;

a driving cylinder, disposed in the cylindrical accommodating space, and provided with a driving cylinder opening and a driving cylinder end portion corresponding to the first port and the second port respectively on two opposite ends, a sidewall of the driving cylinder being provided with a penetration portion, and the driving cylinder being rotatable relative to an axis to the penetration portion to correspond to the engagement recessed portion;

a plurality of circular lock plates, arranged in parallel to each other in the driving cylinder and rotatable along the axis, each of the circular lock plates comprising an inner edge provided with a driving protrusion portion and an outer edge provided with a first recessed portion, and the outer edge of at least one of the circular lock plates being further provided with a second recessed portion; and a lock rod, disposed in the penetration portion and partially entering the engagement recessed portion to restrict rotation of the driving cylinder relative to the housing, wherein when the first key is inserted between the circular lock plates through the first port and the driving cylinder opening, the first key pushes, through the driving protrusion portion, the circular lock plates to rotate to the first recessed portion to correspond to the penetration portion, and the lock rod is movable to partially enter the first recessed portion and detach from the engagement recessed portion, so that the driving cylinder is rotatable relative to the housing; and when the second key is inserted between the circular lock plates through the first port and the driving cylinder opening, the second key pushes, through the driving protrusion portion, the circular lock plates to rotate to the second recessed portion and the first recessed portions of the circular lock plates not provided with the second recessed portion to correspond to the penetration portion, and the lock rod is movable to partially enter the second recessed portion and the first recessed portions of the circular lock plates not provided with the second recessed portion and detach from the engagement recessed portion, so that the driving cylinder is rotatable relative to the housing.

2. The multi-key lock core according to claim 1, wherein outer surfaces of the first key and the second key are provided with a first guide slot and a second guide slot extending along an axial direction of the first key and the second key respectively, and the first guide slot and the second guide slot each comprise a bending portion extending along a circumferential direction of the first key and the second key, wherein when the first key is inserted between the circular lock plates through the first port and the driving cylinder opening, the driving protrusion portion enters the first guide slot, and a sidewall of the first guide slot abuts against the driving protrusion portion and pushes the circular lock plates to rotate to the first recessed portion to correspond to the penetration portion; and when the second key is inserted between the circular lock plates through the first port and the driving cylinder opening, the driving protrusion portion enters the second guide slot, and a sidewall of the second guide slot abuts against the driving protrusion portion and pushes the circular lock plates to rotate to the second recessed portion and the first recessed portions of the circular lock plates not provided with the second recessed portion to correspond to the penetration portion.

3. The multi-key lock core according to claim 1, wherein the outer edge of each of the circular lock plates is further provided with a reset bevel; and the driving cylinder further comprises a reset device, and when the circular lock plates are disposed in the driving cylinder, the reset device abuts against the reset bevel to drive the circular lock plates to rotate to a predetermined position.

4. The multi-key lock core according to claim 1, wherein the outer edge of each of the circular lock plates is further provided with a limiting portion; and the driving cylinder further comprises a limiting opening portion, and when the circular lock plates are disposed in the driving cylinder, the limiting portion is located in the limiting opening portion, and the limiting opening portion restricts a range of rotation of the circular lock plates relative to the driving cylinder.

5. The multi-key lock core according to claim 1, further comprising a plurality of spacers disposed between the circular lock plates.

6. A multi-key lock core, configured for use in combination with a first key and a second key, the multi-key lock core comprising:

a housing, comprising a housing inner wall, the housing inner wall being provided with an engagement recessed portion, and defining a cylindrical accommodating space with a first port and a second port;

a driving cylinder, disposed in the cylindrical accommodating space, and provided with a driving cylinder opening and a driving cylinder end portion corresponding to the first port and the second port respectively on two opposite ends, a sidewall of the driving cylinder being provided with a penetration portion, and the driving cylinder being rotatable relative to an axis to the penetration portion to correspond to the engagement recessed portion;

a first circular lock plate, disposed in the driving cylinder and rotatable along the axis, provided with a driving protrusion portion on an inner edge, and provided with a first A recessed portion on an outer edge;

a second circular lock plate, disposed in parallel to the first circular lock plate in the driving cylinder and rotatable along the axis, provided with the driving protrusion portion on an inner edge, and provided with a first B recessed portion and a second recessed portion on an outer edge; and a lock rod, disposed in the penetration portion and partially entering the engagement recessed portion to restrict rotation of the driving cylinder relative to the housing, wherein when the first key is inserted between the first circular lock plate and the second circular lock plate through the first port and the driving cylinder opening, the first key pushes, through the driving protrusion portion, the first circular lock plate and the second circular lock plate to rotate to the first A recessed portion and the first B recessed portion to correspond to the penetration portion, and the lock rod is movable to partially enter the first A recessed portion and the first B recessed portion and detach from the engagement recessed portion, so that the driving cylinder is rotatable relative to the housing; and when the second key is inserted between the first circular lock plate and the second circular lock plate through the first port and the driving cylinder opening, the second key pushes, through the driving protrusion portion, the first circular lock plate and the second circular lock plate to rotate to the first A recessed portion and the second recessed portion to correspond to the penetration portion, and the lock rod is movable to partially enter the first A recessed portion and the second recessed portion and detach from the engagement recessed portion, so that the driving cylinder is rotatable relative to the housing.

7. The multi-key lock core according to claim 6, wherein outer surfaces of the first key and the second key are provided with a first guide slot and a second guide slot extending along an axial direction of the first key and the second key respectively, and the first guide slot and the second guide slot each comprise a bending portion extending along a circumferential direction of the first key and the second key, wherein when the first key is inserted between the first circular lock plate and the second circular lock plate through the first port and the driving cylinder opening, the driving protrusion portion enters the first guide slot, and a sidewall of the first guide slot abuts against the driving protrusion portion and pushes the first circular lock plate and the second circular lock plate to rotate to the first A recessed portion and the first B recessed portion to correspond to the penetration portion; and when the second key is inserted between the first circular lock plate and the second circular lock plate through the first port and the driving cylinder opening, the driving protrusion portion enters the second guide slot, and a sidewall of the second guide slot abuts against the driving protrusion portion and pushes the first circular lock plate and the second circular lock plate to rotate to the first A recessed portion and the second recessed portion to correspond to the penetration portion.

8. The multi-key lock core according to claim 6, wherein outer edges of the first circular lock plate and the second circular lock plate each are further provided with a reset bevel; and the driving cylinder further comprises a reset device, and when the first circular lock plate and the second circular lock plate are disposed in the driving cylinder, the reset device abuts against the reset bevel to drive the first circular lock plate and the second circular lock plate to rotate to a predetermined position.

9. The multi-key lock core according to claim 6, wherein outer edges of the first circular lock plate and the second circular lock plate each are further provided with a limiting portion; and the driving cylinder further comprises a limiting opening portion, and when the first circular lock plate and the second circular lock plate are disposed in the driving cylinder, the limiting portion is located in the limiting opening portion, and the limiting opening portion restricts a range of rotation of the first circular lock plate and the second circular lock plate relative to the driving cylinder.

10. The multi-key lock core according to claim 6, further comprising a spacer disposed between the first circular lock plate and the second circular lock plate.

* * * * *